US007011220B2

(12) United States Patent
Deye

(10) Patent No.: US 7,011,220 B2
(45) Date of Patent: Mar. 14, 2006

(54) RACK FOR HOLDING FIREWORKS FOR IGNITION

(75) Inventor: James G. Deye, Cincinnati, OH (US)

(73) Assignee: Shooting Star Products, Inc., Cincinnati, OH (US)

( * ) Notice: Subject to any disclaimer, the term of this patent is extended or adjusted under 35 U.S.C. 154(b) by 225 days.

(21) Appl. No.: 10/740,718

(22) Filed: Dec. 18, 2003

(65) Prior Publication Data

US 2005/0133472 A1 Jun. 23, 2005

(51) Int. Cl.
*A47F 7/00* (2006.01)

(52) U.S. Cl. ..... 211/60.1

(58) Field of Classification Search ..... 211/60.1, 211/62, 67, 68, 70.4, 70.6, 71.01; 102/217, 102/361, 343
See application file for complete search history.

(56) References Cited

U.S. PATENT DOCUMENTS 1,597,565 A * 8/1926 Backus ..... 211/62
1,808,811 A * 6/1931 Gioiosa ..... 102/359
5,338,261 A * 8/1994 Stegman ..... 473/1
5,429,053 A * 7/1995 Walker ..... 102/342
5,979,329 A * 11/1999 Collar ..... 102/361
6,123,205 A * 9/2000 Dumitrescu et al. ..... 211/74
6,393,990 B1 * 5/2002 Fagan ..... 102/342

* cited by examiner

*Primary Examiner*—Sarah Purol
(74) *Attorney, Agent, or Firm*—Sand & Sebolt

(57) ABSTRACT

A rack for holding fireworks in position for ignition. The rack is a lightweight frame having end supports that are connected together by a brace. The brace includes at least one aperture into which a firework-holding tube is received. A resilient bushing extends into the aperture and the frame includes an ignitor cord retaining system. The frame rests upon a flat surface and the end supports and tube both contact that flat surface. The recoil from the launched fireworks is transmitted into the flat surface and into the bushing that surrounds the tube. The frame includes holes that allow air to escape if a device explodes and also includes ways for the frame to disintegrate to reduce the production of shrapnel if a firework device explodes within the tube. A number of frames may be connected together to form a bank of firework holding devices.

36 Claims, 21 Drawing Sheets

RACK FOR HOLDING FIREWORKS FOR IGNITION

BACKGROUND OF THE INVENTION

1. Technical Field

This invention generally relates to a device for holding fireworks so that they can be ignited. More particularly, the invention relates to a frame into which a number of fireworks can be inserted for sequential ignition. More specifically, the invention relates to a lightweight frame that can be permanently fixed together either singularly or in groups, that cannot easily tip over and does not create much shrapnel if a pyrotechnic device explodes in the frame.

2. Background Information

It is common for cities and community organizations to set off firework displays to celebrate various occasions and holidays. The fireworks used in these celebrations can be large and they need to be held in a manner that allows them to be easily ignited. It is therefore common for an organization to build a rack to hold the fireworks. These types of celebrations do not occur frequently and it is therefore fairly typical that the racks are made from 2"×4" lumber, nails and other components that the organization can easily and quickly afford to put together. It is also quite common for organizations to store the racks between their infrequent uses, so that they do not need to be rebuilt for each occasion. The structures built in this manner tend to be fairly easily damaged when they are stored, or when they are removed from storage and erected for a display. They also tend to get damaged when fireworks are launched from them. It is also common for these racks to be easily knocked over by the people lighting the fireworks or as the fireworks are propelled out of them. This may result in the fireworks being shot into the audience or into the midst of the personnel igniting the displays. Additionally, because the racks are made from lumber connected together by screws or nails, if a rocket explodes within the rack, portions of the rack become shrapnel and may hurt or kill spectators or crew members setting off the fireworks.

There is therefore a need in the art for a rack for holding fireworks for ignition that will tend to remain upright during ignition and firing of the fireworks, which will produce very little shrapnel in the event of an explosion and may be stored easily and with less chance of damage being done to the rack.

SUMMARY OF THE INVENTION

The firework holding rack of the present invention comprises one or more frames that include end supports connected together by at least one brace. The brace includes an aperture through which a firework-receiving tube is inserted. The bottom of the tube preferably lays coplanar with the bottom of the end supports so that the recoil from a firework launch from the rack is substantially absorbed by the surface on which the tube and end supports stand. The brace also includes a bushing for absorbing the recoil of the launch. One or more frames may be connected together to form a bank of firework ignition and launching devices. The frames include a system for retaining an ignitor cord so that the crew lighting the fireworks display can stand remote from the frame.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
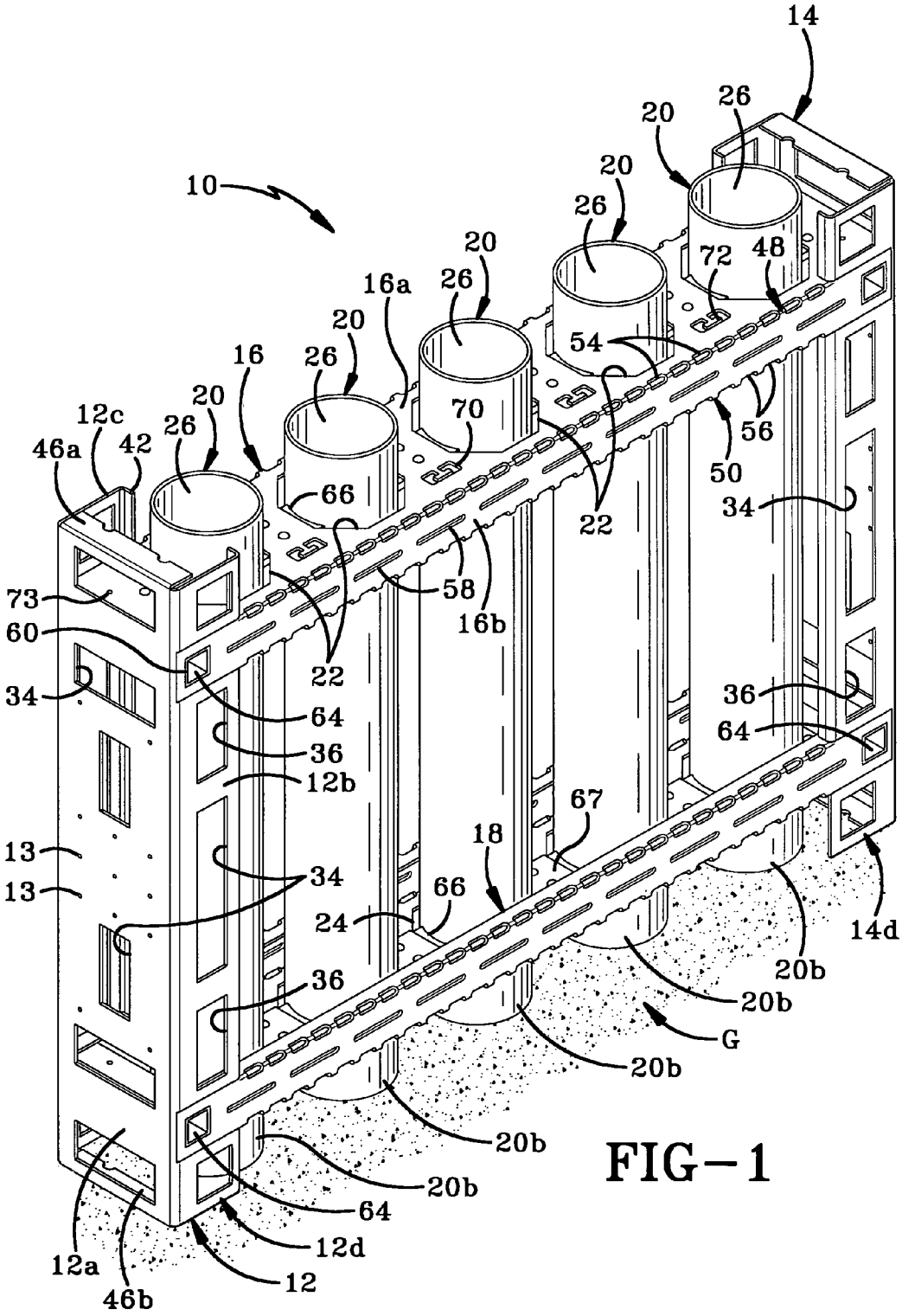
FIG. 1 is a perspective view of the rack for retaining fireworks in accordance with the present invention.
Figure 2:
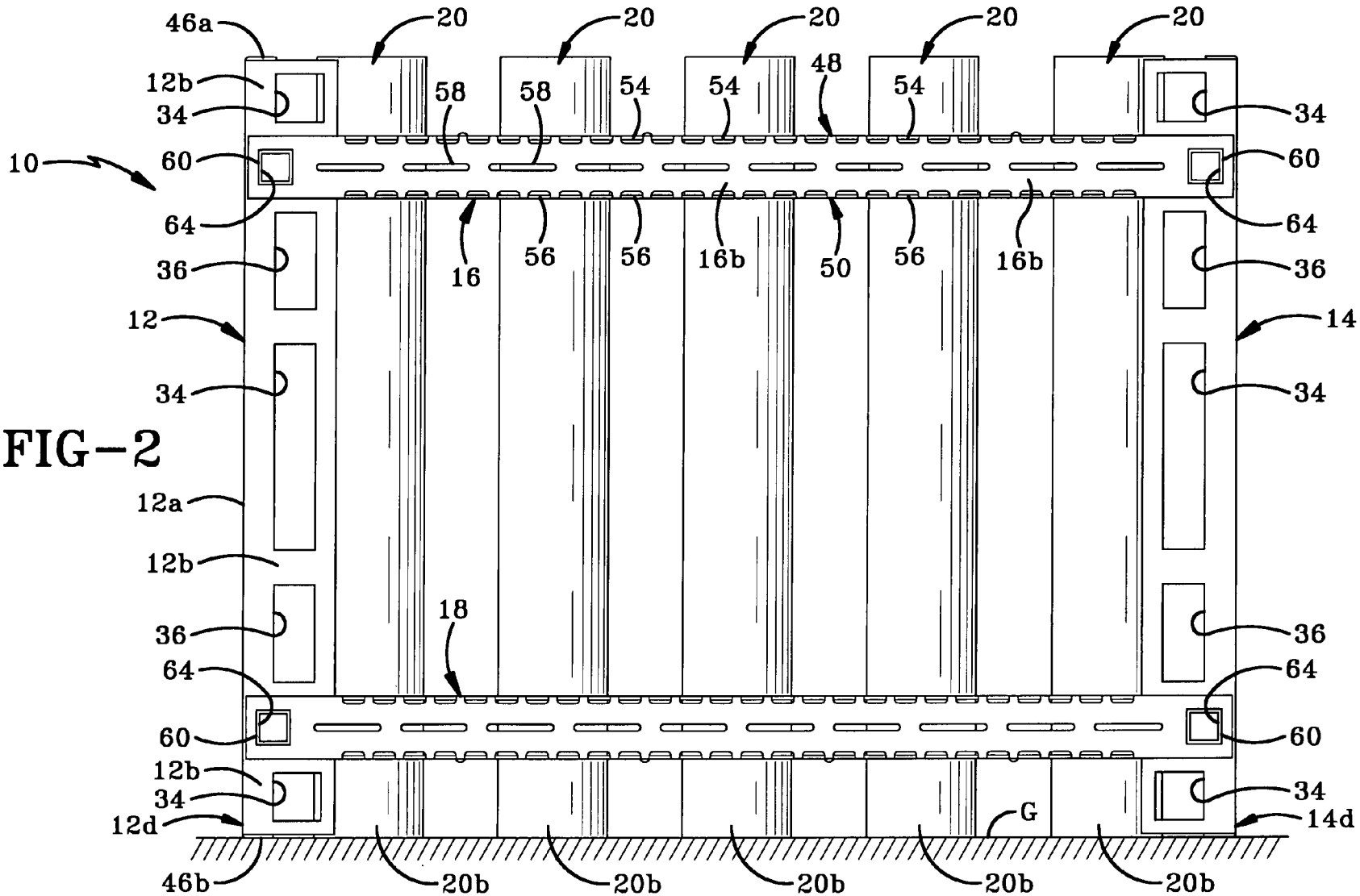
FIG. 2 is a front elevational view of the rack of FIG. 1.
Figure 3:
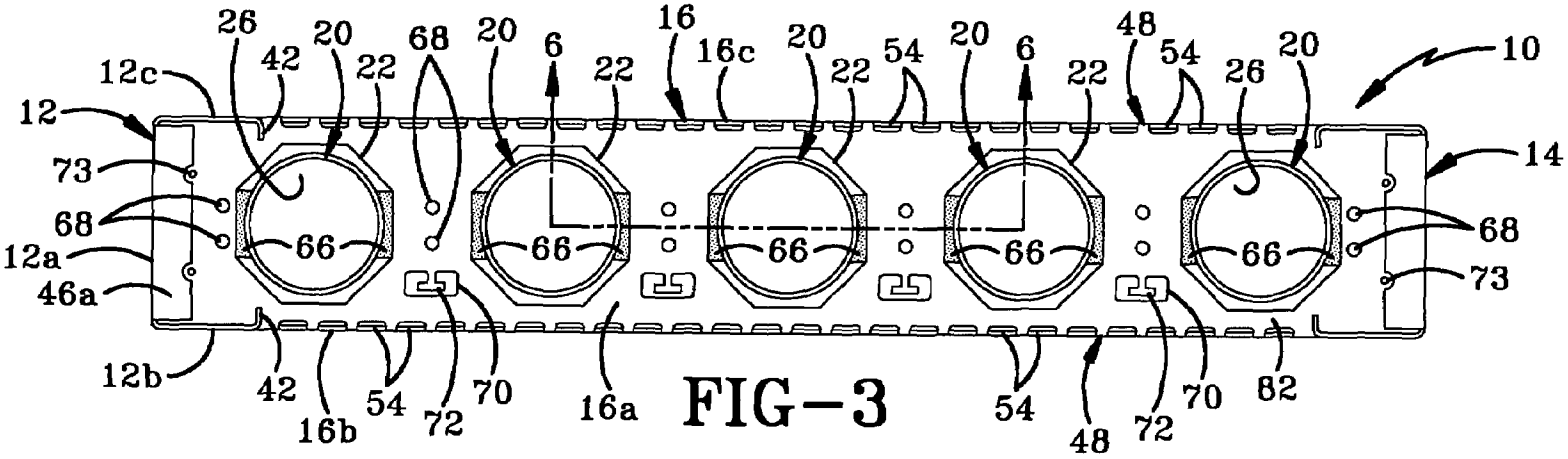
FIG. 3 is a top view of the rack of FIG. 1.

Referring to FIGS. 1–6 there is shown a rack or frame, generally indicated at 10, for holding fireworks 28 for ignition. Rack 10 includes two opposing end supports 12 and 14 connected together by braces 16 and 18. A plurality of hollow, cylindrical tubes 20 are held in apertures 22 and 24 in braces 16, 18. Pyrotechnics or fireworks 28, such as rockets, are inserted into the bores 26 of tubes 20. Fireworks 28 are connected to an ignitor cord 30 by ignitor wires 32.

Ignitor cord 30 (FIG. 5) is lit by a suitable ignition source (not shown) and the fireworks 28 are propelled out of the tubes 20.

End supports 12, 14 and braces 16, 18 of rack 10 preferably are manufactured from a heavy gauge, strong, lightweight material such as aluminum, while tubes 20 preferably are manufactured from high density polyethylene (HDPE) or fiberglass. End supports 12, 14 and braces 16, 18 are welded or riveted together. It is less desirable to use screws or nuts and bolts to join these components together as screws and the like could become projectiles in the event that a pyrotechnic device explodes in rack 10. The entire rack 10 preferably is tumbled during manufacture to remove all sharp edges from supports 12, 14 and braces 16, 18.

Figure 10:
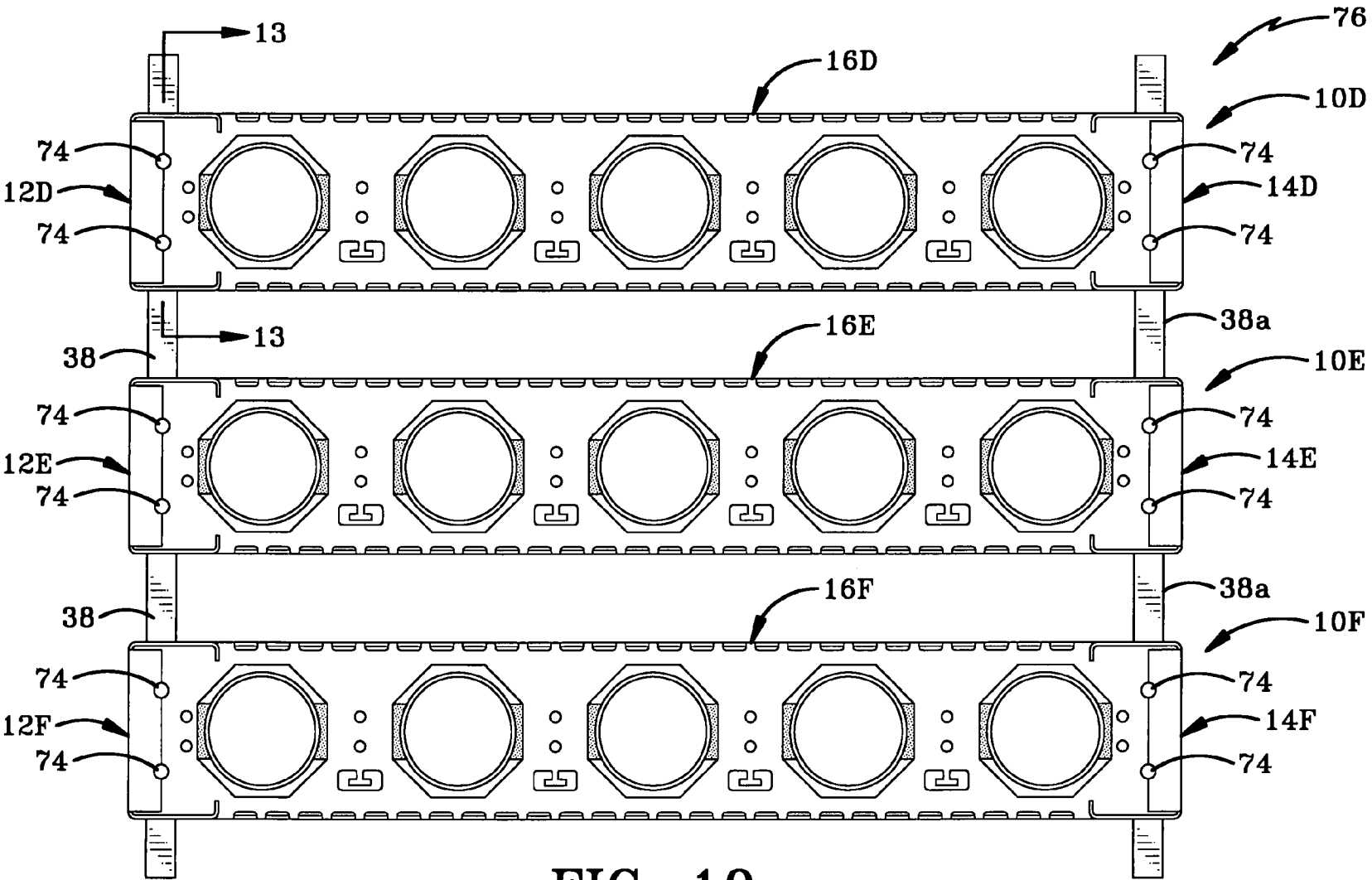
FIG. 10 is a top view showing three racks connected together to hold a plurality of fireworks FIG. 11 a partial cut-away perspective view of the end of the rack showing the tie bar to be used to connect adjacent racks.
Figure 11:
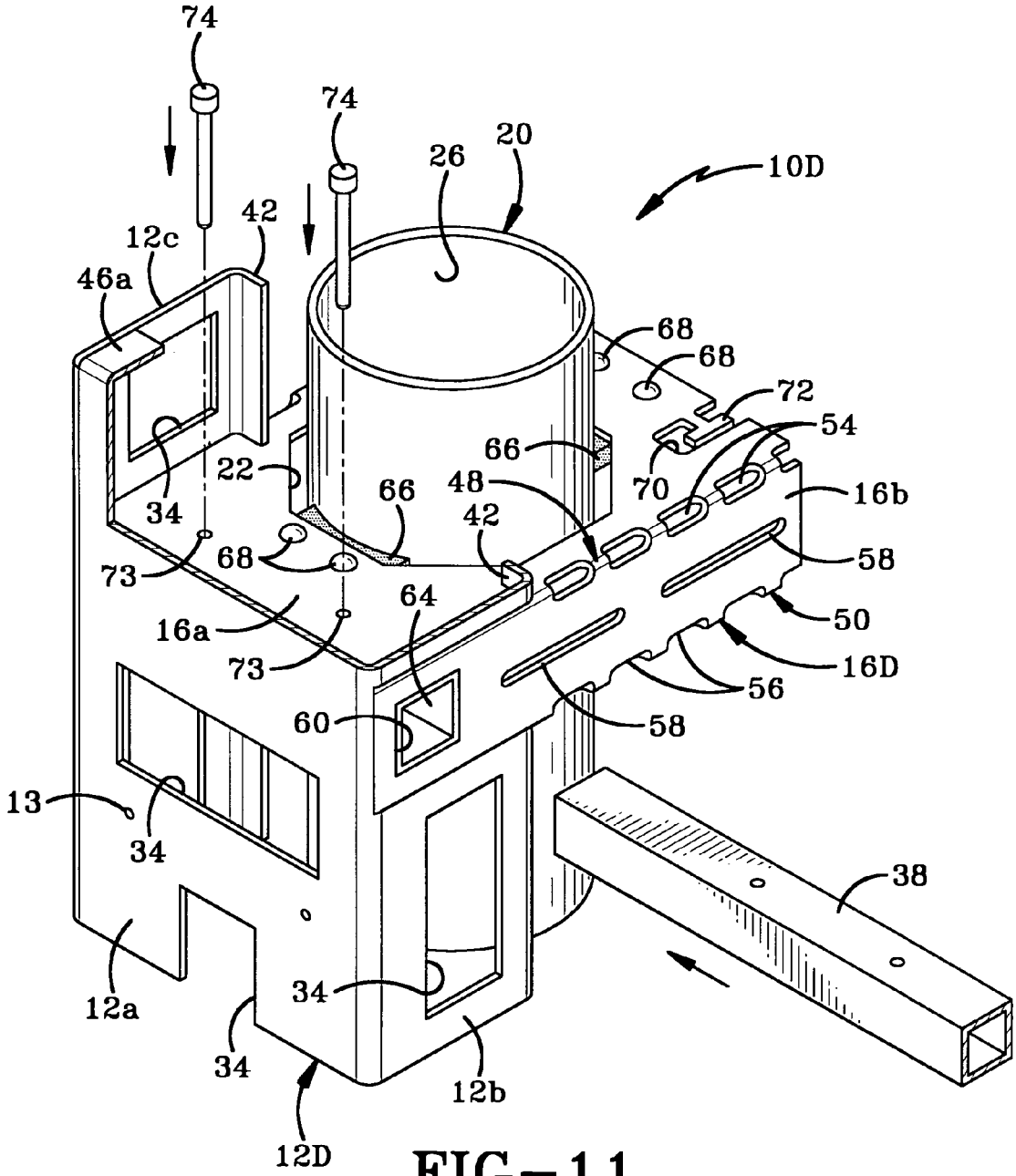
Figure 12:
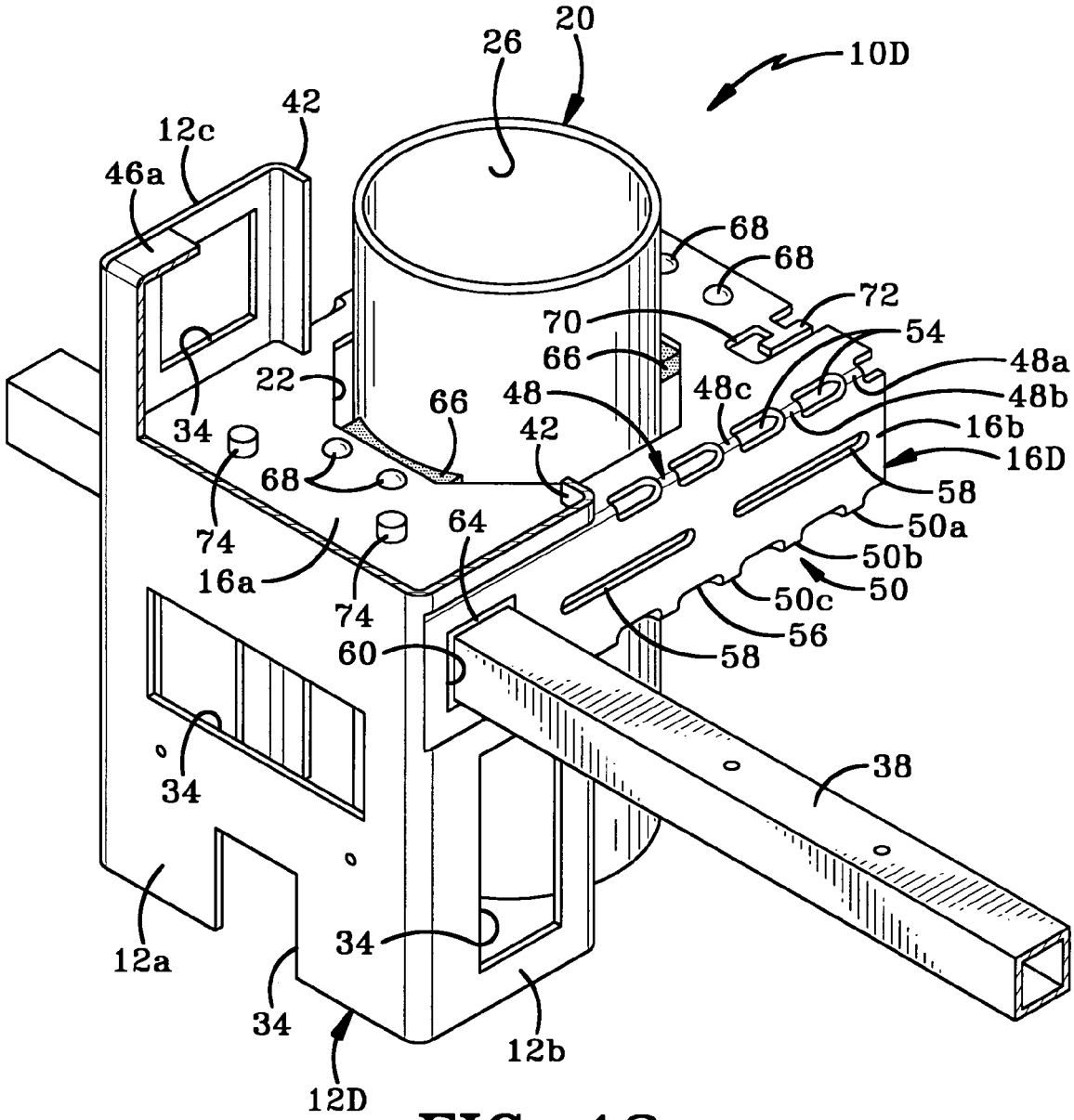
FIG. 12 is a partial cross-sectional perspective view of the rack of FIG. 11 showing the tie bar inserted into the rack.
Figure 13:
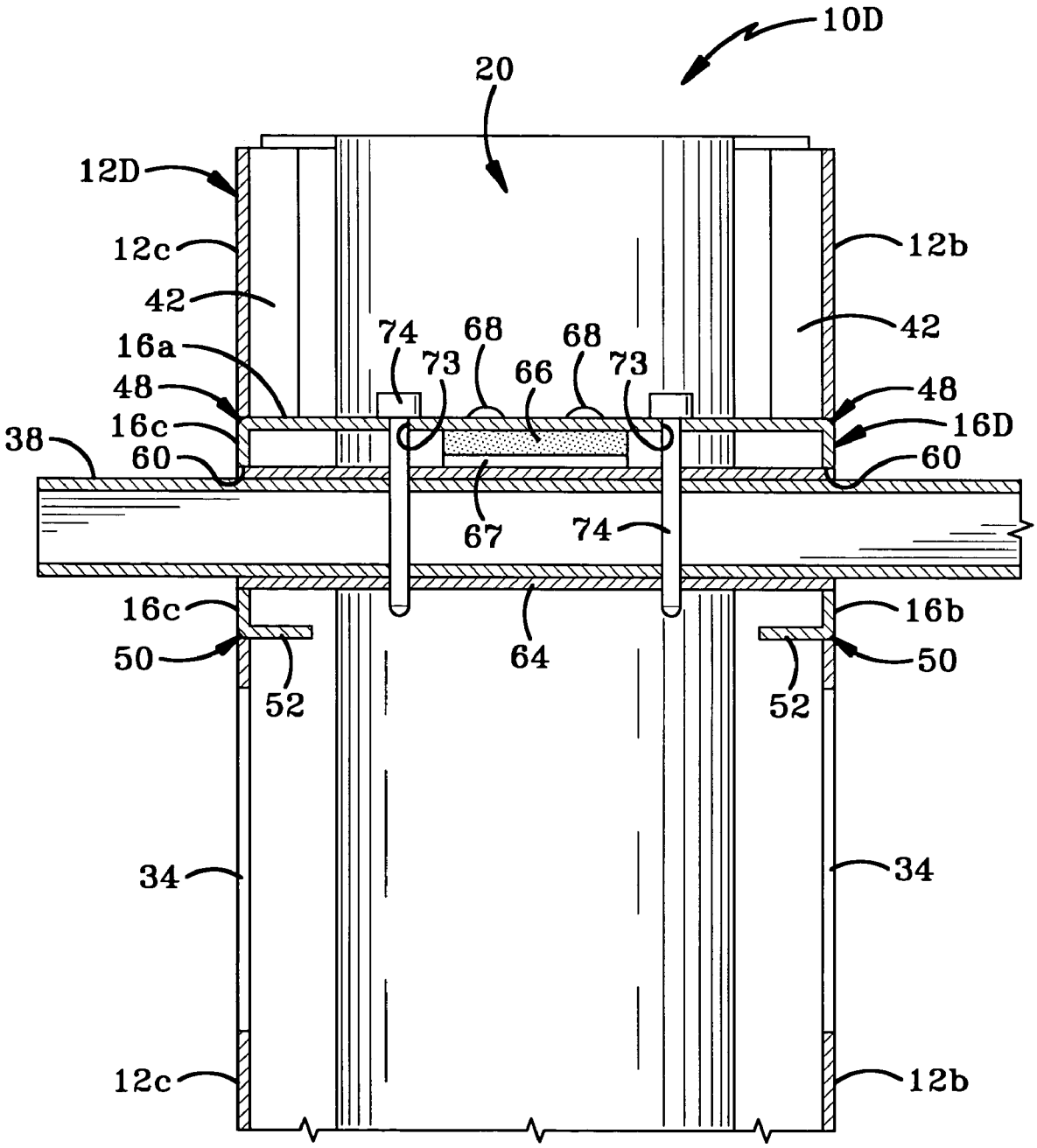
FIG. 13 is a partial cross-sectional side view of the rack through lines 13—13 of FIG. 10, showing a connector rod inserted through a rack.
Figure 14:
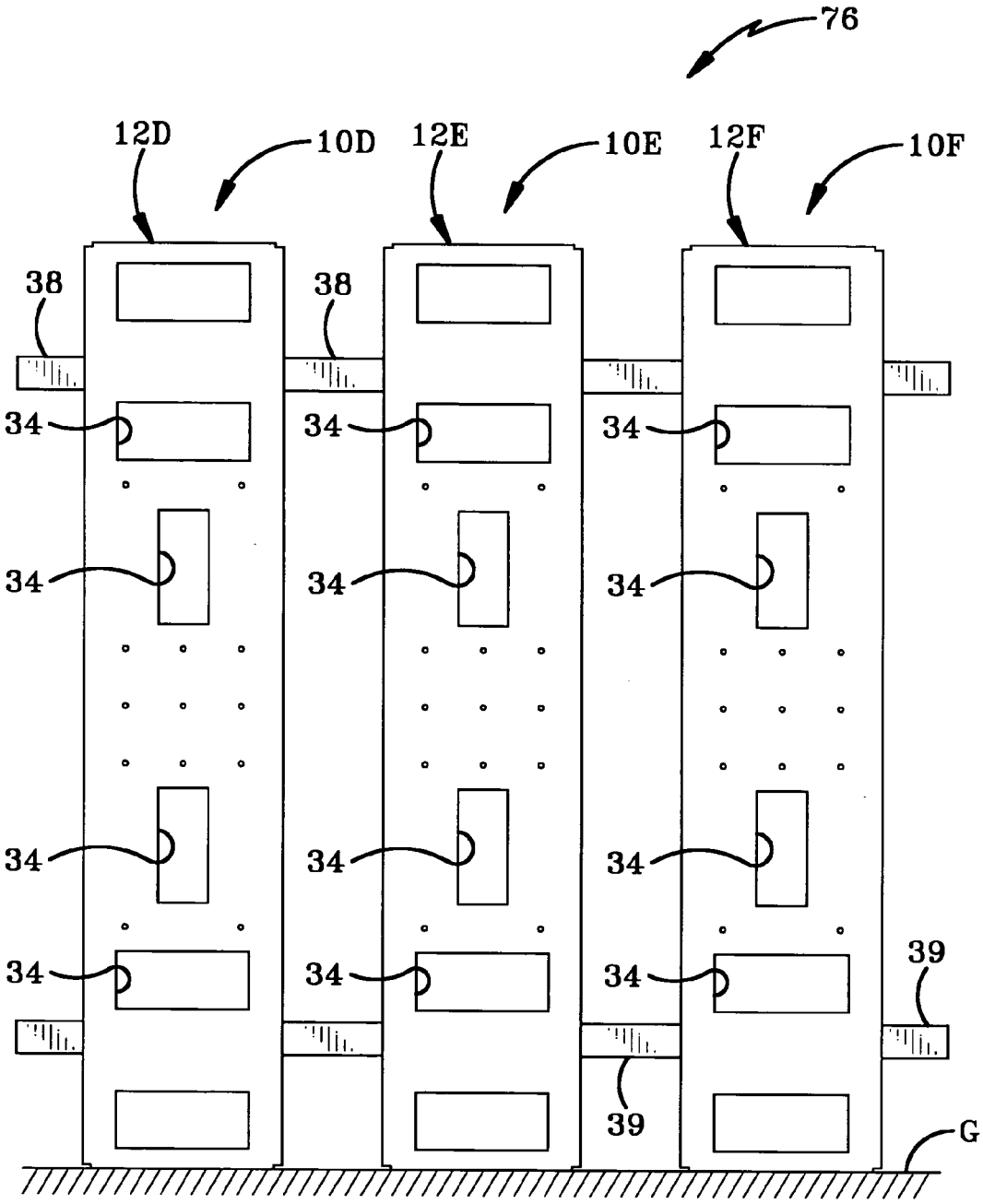
FIG. 14 is a side elevational view showing three racks connected together.

End supports 12 and 14 are identically shaped. The following description refers to support 12, but it applies equally to substantially identical support 14. Support 12 is an essentially U-shaped member having a rear wall 12*a* and two smaller side walls 12*b* and 12*c* extending outwardly therefrom. The lower sections 12*d* of supports 12, are adapted to rest on the ground G, or on the bed of a truck or barge. Each of rear wall 12*a* and side walls 12*b*, 12*c* defines a plurality of variously oriented and sized holes 34 and 36 therein. All of holes 34, 36 provide a way for air to escape from rack 10 in the event of an explosion of a firework 28 held within rack 10. This aids in preventing rack 10 from disintegrating upon such an event occurring. Holes 34, 36 may also be used as handles for a user to carry rack 10. Some of holes 36 are sized to receive connector rods 38 therethrough (as shown and described hereafter with reference to FIGS. 10–12). Flanges 46*a* and 46*b* may be provided on the upper and lower ends of rear wall 12*a* to increase the strength and stability of end support 12. Flange 46*b* on lower section 12*d* assists in providing a stable bottom surface on which end support 12 can rest on the ground G. Flanges 42 are provided along the outside longitudinal edge of side walls 12*b* and 12*c* and flanges 42 extend over the upper wall 16*a* of braces 16 and 18 to hold rack 10 together in a rigid and stable manner. Rack 10 may also be provided with legs (not shown) that may be connected to lower sections 12*d* and 14*d* of supports 12 and 14.

Figure 5:
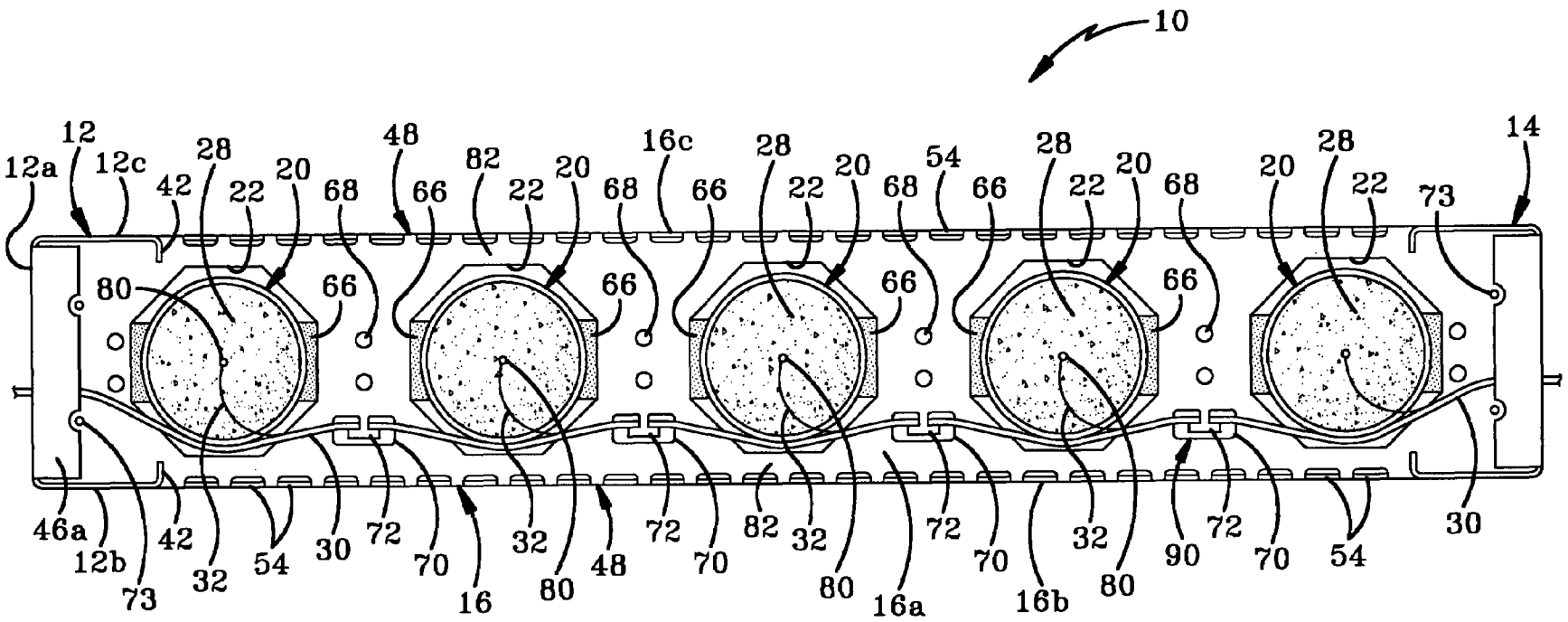
FIG. 5 is a top view of the rack showing a plurality of fireworks held in the tubes and ready for ignition.
Figure 6:
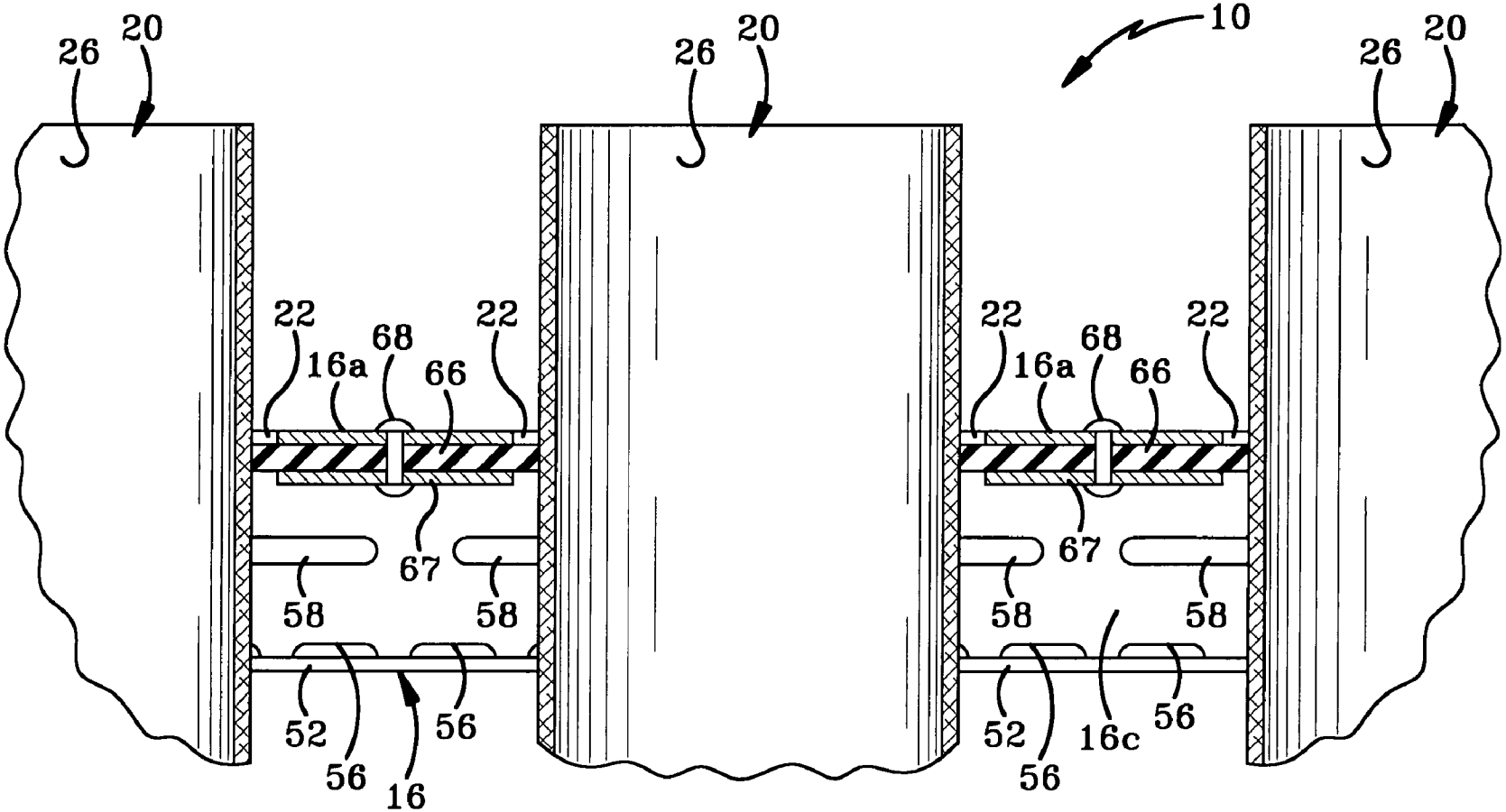
FIG. 6 is a partial cross-sectional front view of the rack through lines 6—6 of FIG. 3, showing the connection between the firework tubes and support brace.

Referring still to FIGS. 1–6, braces 16 and 18 are essentially identical, and while the following description pertains to brace 16, it should be understood that it applies equally to brace 18. Brace 16 preferably is U-shaped and has an upper wall 16*a* and two side walls 16*b*, 16*c* extending downwardly therefrom. Brace 16 may be manufactured from a single piece of aluminum that is bent at a corner edges 48 and 50 to form side walls 16*b*, 16*c* and a longitudinal flange 52 (FIG. 6). Side walls 12*c*, 12*d* may be partially cut-away to receive side walls 16*b*, 16*c* of brace and side walls 12*c*, 12*d* preferably are welded to brace 16. It will be understood that brace 16 may alternatively be partially cut-away to receive side walls 12*b*, 12*c* of support 12 without departing from the spirit of the present invention. Corner edges 48 and 50 of brace 16 may include a plurality of apertures 54 and 56 along their length. A plurality of slots 58 are also provided along the length of side walls 16*b* and 16*c*. Apertures 54, 56 and slots 58 allow for air to escape from rack 10 if a firework device 28 in rack 10 explodes. The side walls 16*b*, 16*c* of brace 16 may also be provided with apertures 60 which are coaxially aligned with holes (not shown) in end supports 12, 14. A connector guide 64 may be inserted through aligned holes 60 in brace 16 and support 12 and welded into place to assist in locking brace 16 to support 12. A bushing 66 extends partially into the apertures 22 in the upper wall 16*a* of brace 16. Bushings 66 preferably are manufactured of neoprene or rubber and are secured in place between upper wall 16*a* and a plate 67 by way of rivets 68 (FIG. 6). Bushings 66 cushion the tube 20 against axial movement when a firework device 28 is propelled out of tube 20 and dampen the effect on rack 10 when fireworks 28 are launched therefrom.

Brace 16 also includes an ignitor cord retaining system, generally indicated at 90. Ignitor cord retaining system 90 comprises a plurality of spaced apart holes 70 into which tabs 72 extend. Holes 70 are shown as being defined in upper wall 16*a* of brace 16, but it will be understood by those skilled in the art that the holes 70 and tabs 72 may be provided on side walls 16*b*, 16*c* without departing from the spirit of the present invention. Furthermore, tabs 72 may be T-shaped or may have any other-shaped configuration that will allow ignitor cord 30 to be retained thereunder. Each tab 72 may extend only partially into hole 70 or may extend across the entire width of hole 70. FIG. 5 shows that ignitor cord 30 is threaded under the series of tabs 72 on brace 16 and that a plurality of ignition wires 32 extend from ignitor cord 30 to the plurality of fireworks 28 disposed in tubes 20.

Figure 7:
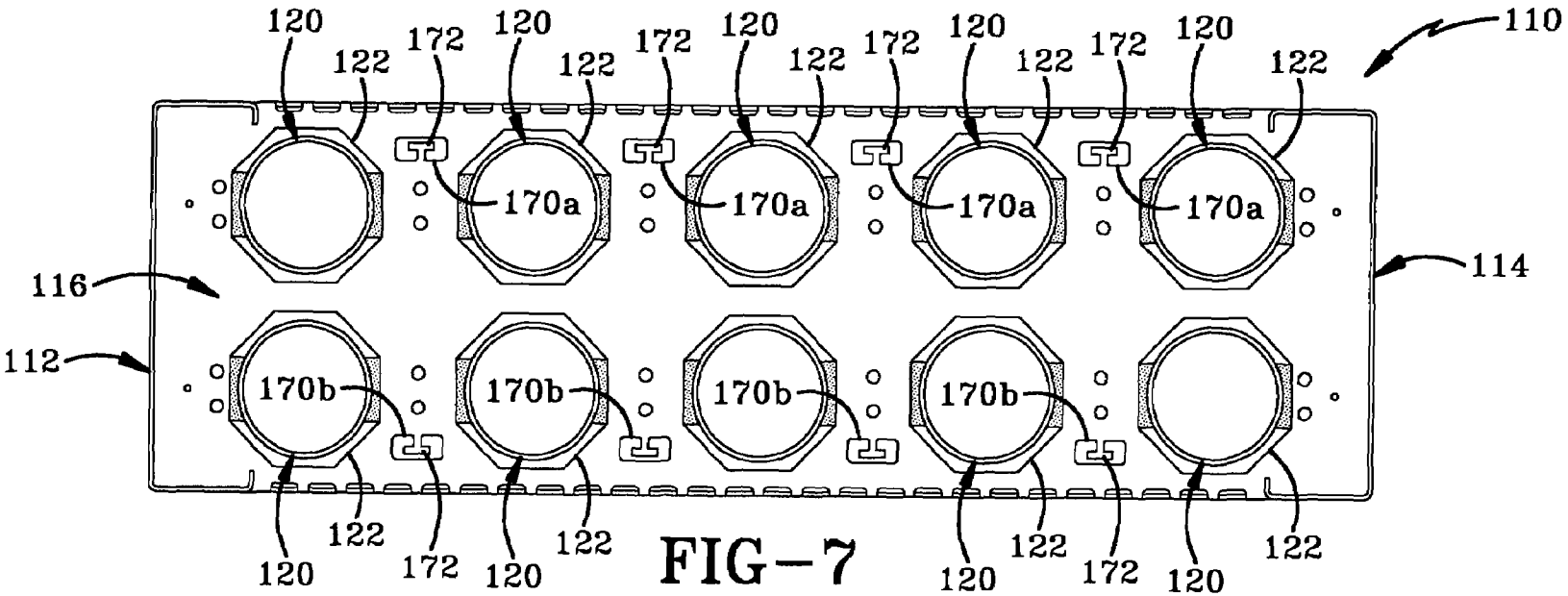
FIG. 7 is a top view of a rack for retaining fireworks showing a second embodiment in which two rows of fireworks supported by the rack.
Figure 4:
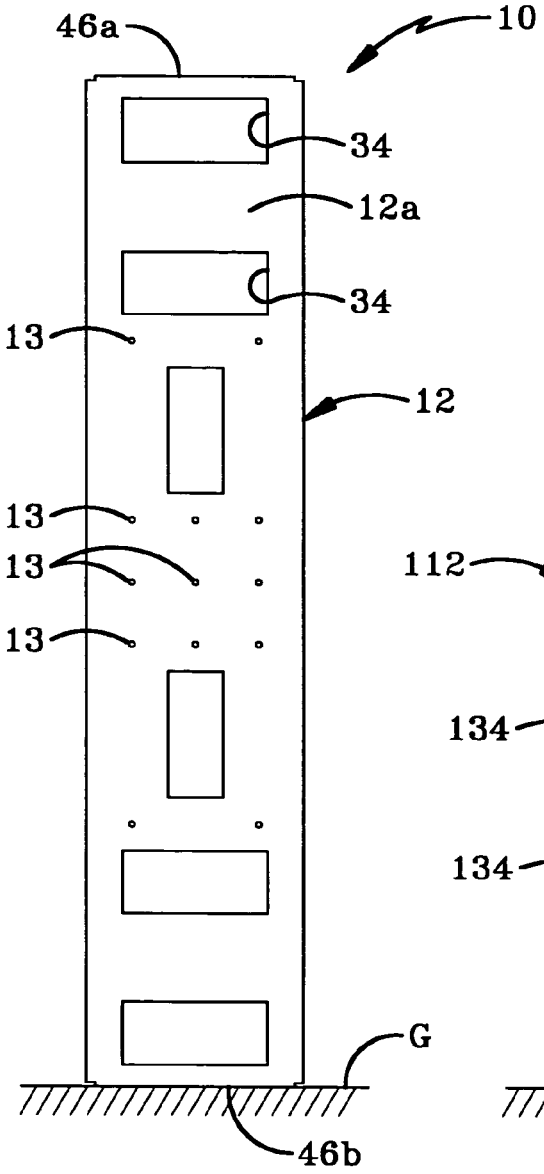
FIG. 4 is side view of the rack.
Figure 8:
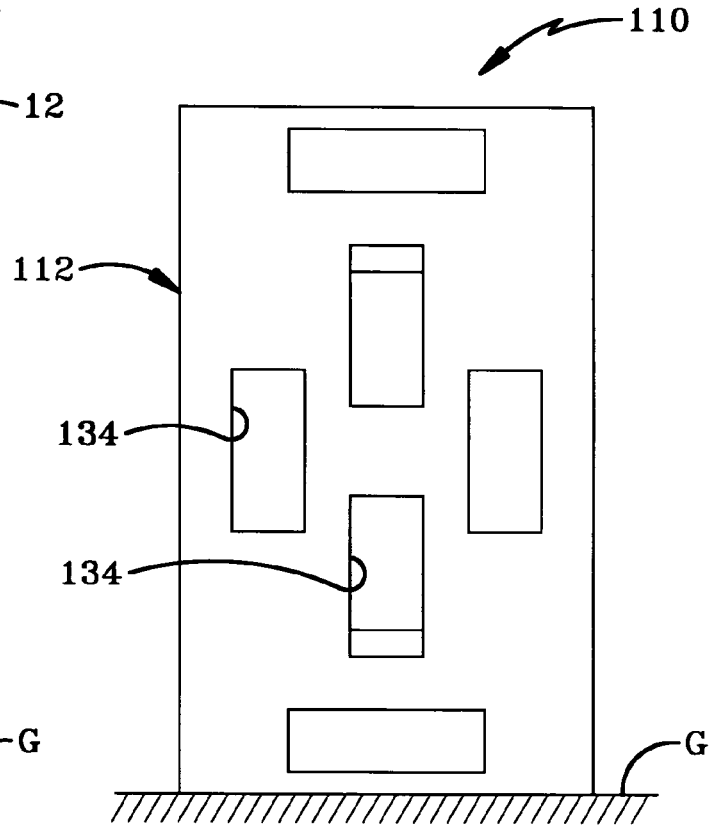
FIG. 8 is a side view of the rack of FIG. 7.
Figure 9:
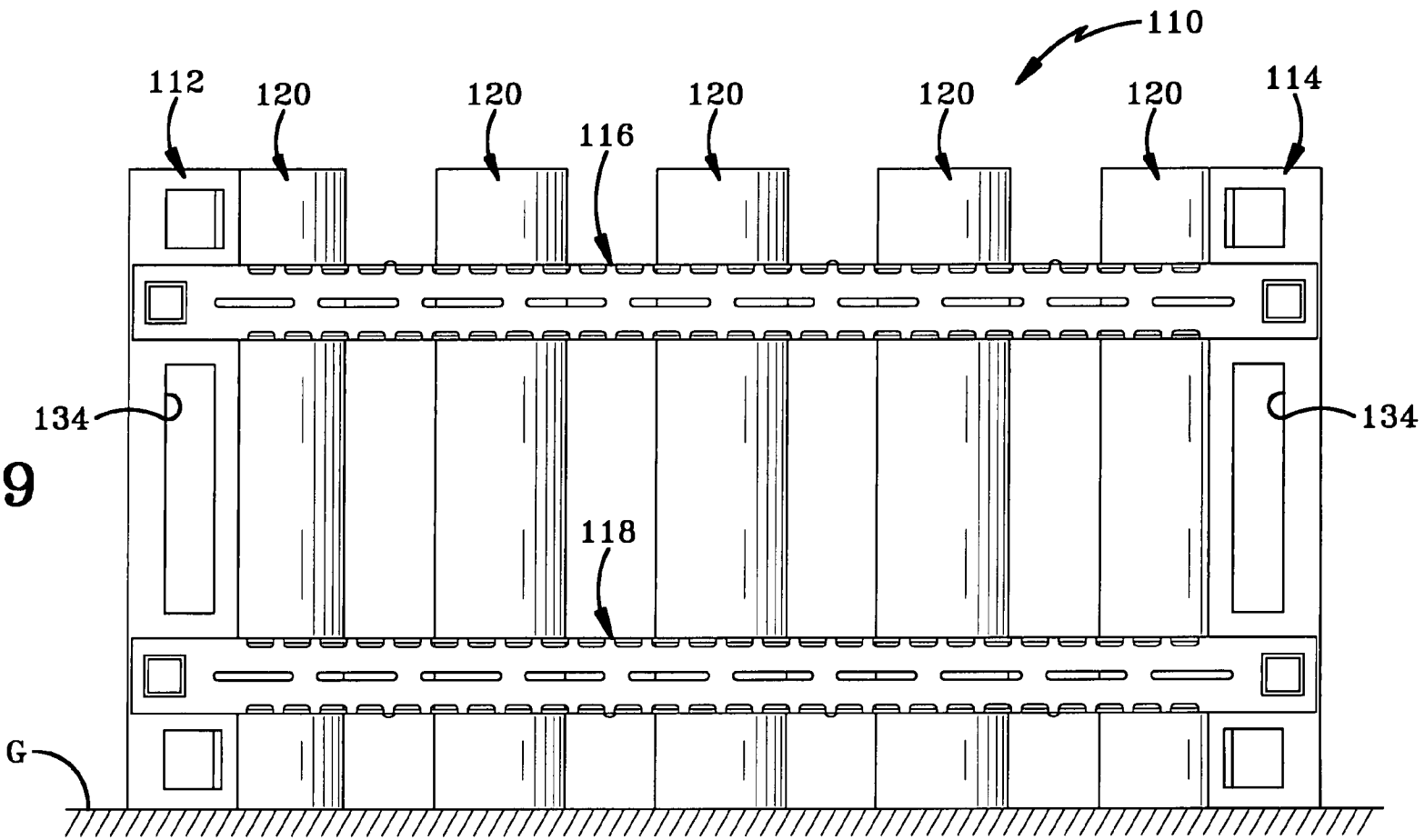
FIG. 9 is a front elevational view of the rack of FIG. 9.

FIGS. 7–9 illustrate a second embodiment of a rack, generally indicated at 110. Rack 110 is similar in structure and function to rack 10, except that the braces 116 and 118 include two rows of apertures 122 into which tubes 120 are received. End supports 112 and 114 include a plurality of holes 134 to allow air to escape in the event of an explosion in rack 110. Brace 116 includes two rows of apertures 170*a* and 170*b* having T-shaped tabs 172 extending thereinto, each row 170*a*, 170*b* being adapted to engage a separate fuse (not shown).

Referring to FIGS. 10–14, more than one rack 10D, 10E and 10F for holding fireworks may be joined together. This is achieved by sequentially inserting a connecting rod 38 through the connector guides 64 in the coaxially aligned holes 60 of each of the braces 16D, 16E, 16F and supports 12D, 12E and 12F of the plurality of racks 10D, 10E and 10F. Once rod 38 is inserted through guides 64, a plurality of pins or nails 74 are inserted into holes 73 to join the upper wall of each brace 16D, 16E and 16F to connecting rod 38. In a similar fashion, a connecting rod 38*a* is inserted through aligned holes (not shown) in support 14D, 14E and 14F. As may be seen from FIG. 14, additional connector rods 39 are inserted through supports 12D, 12E and 12F and brace 18 (not numbered in this Figure). Though not specifically illustrated, a rod may also be inserted through supports 14D, 14E and 14F and brace 18. In this way a stable and rigid rack system 76 is formed. It is contemplated that up to sixteen racks could be connected together along a ten foot long connector rod 38.

Figure 15:
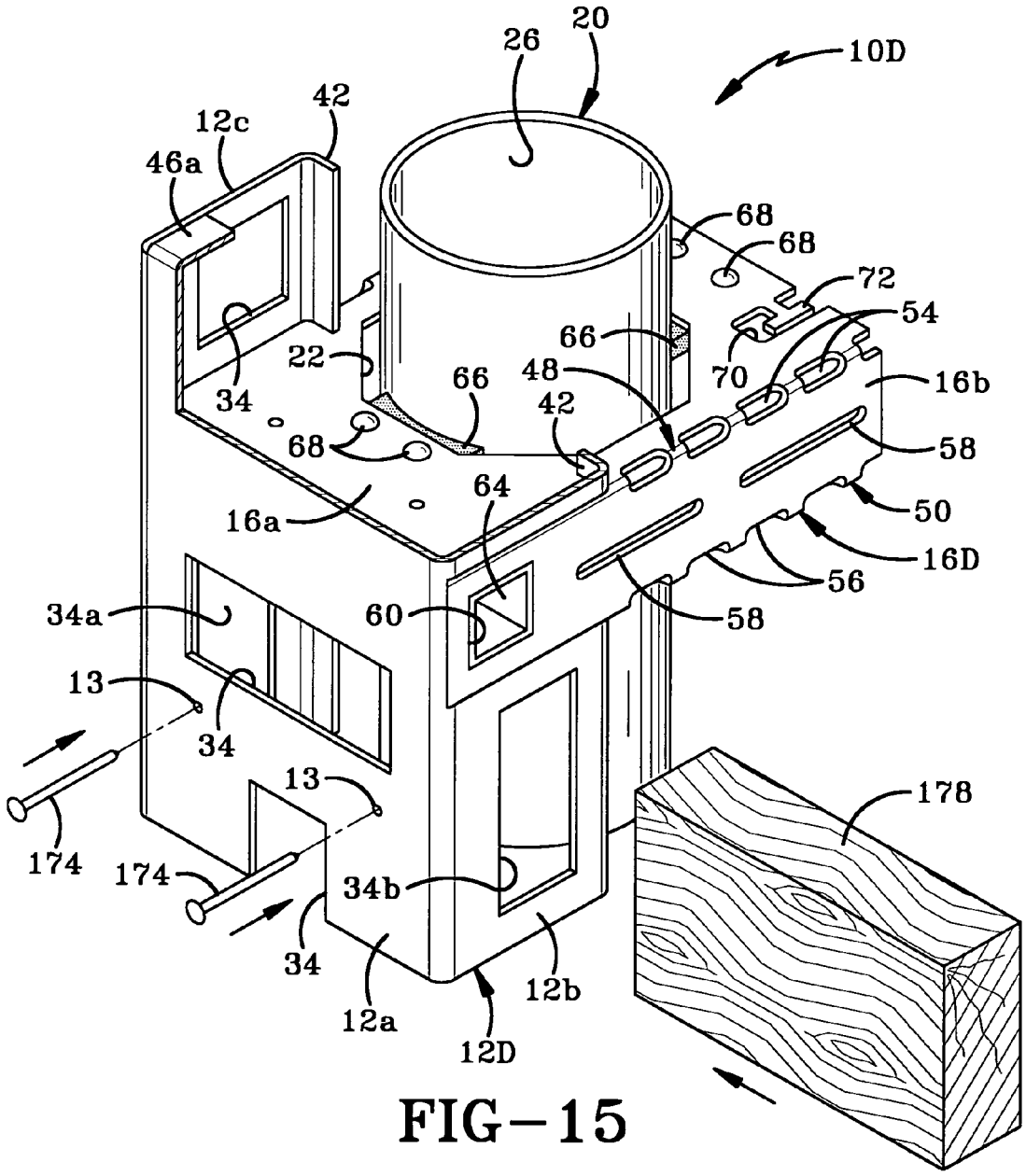
FIG. 15 is a partial cross-sectional perspective view of an end of the rack showing a 2×4 being used to connect adjacent racks together.
Figure 16:
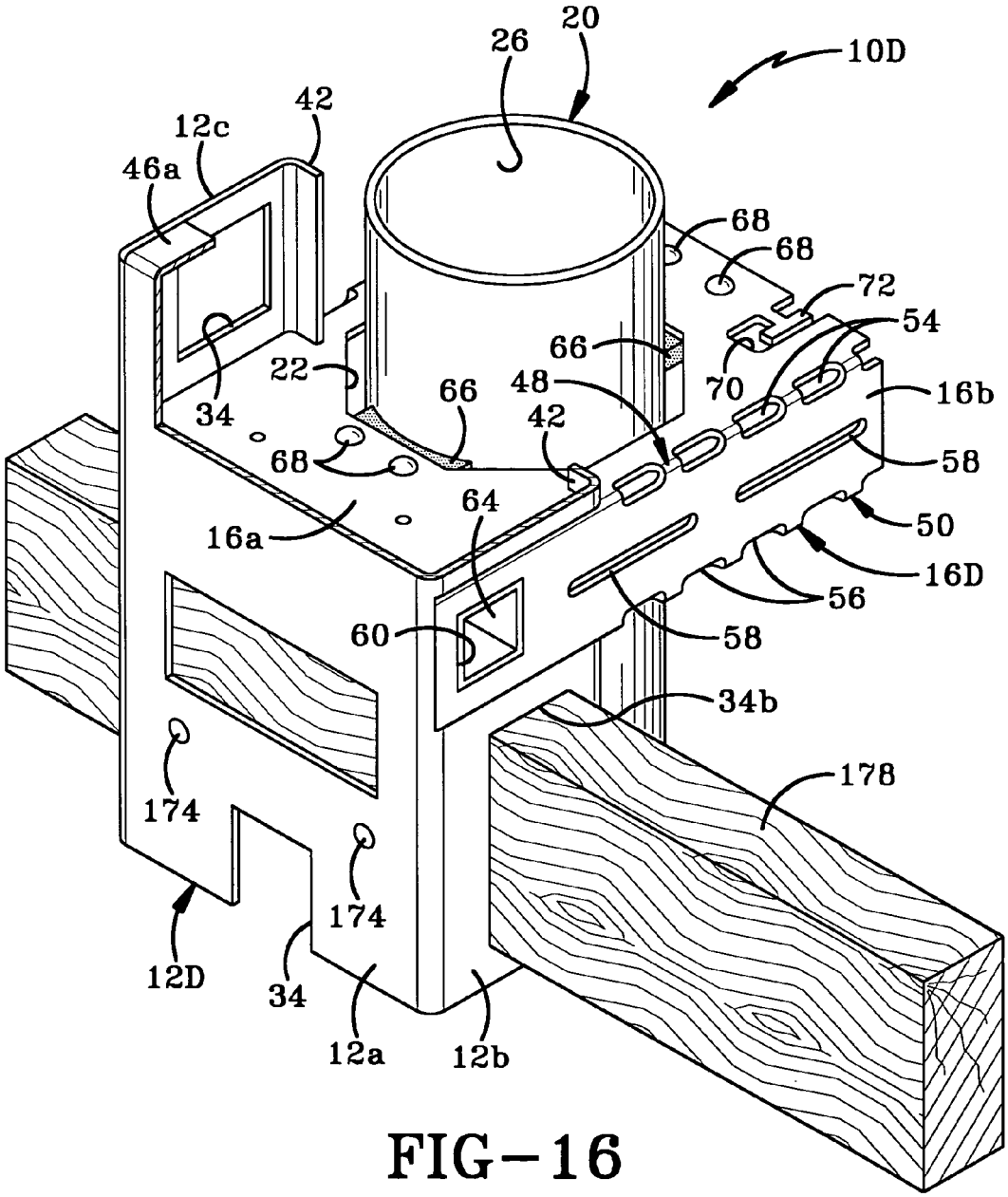
FIG. 16 is a partial cross-sectional perspective view of the rack showing the rack with the 2×4 connected to it.
Figure 17:
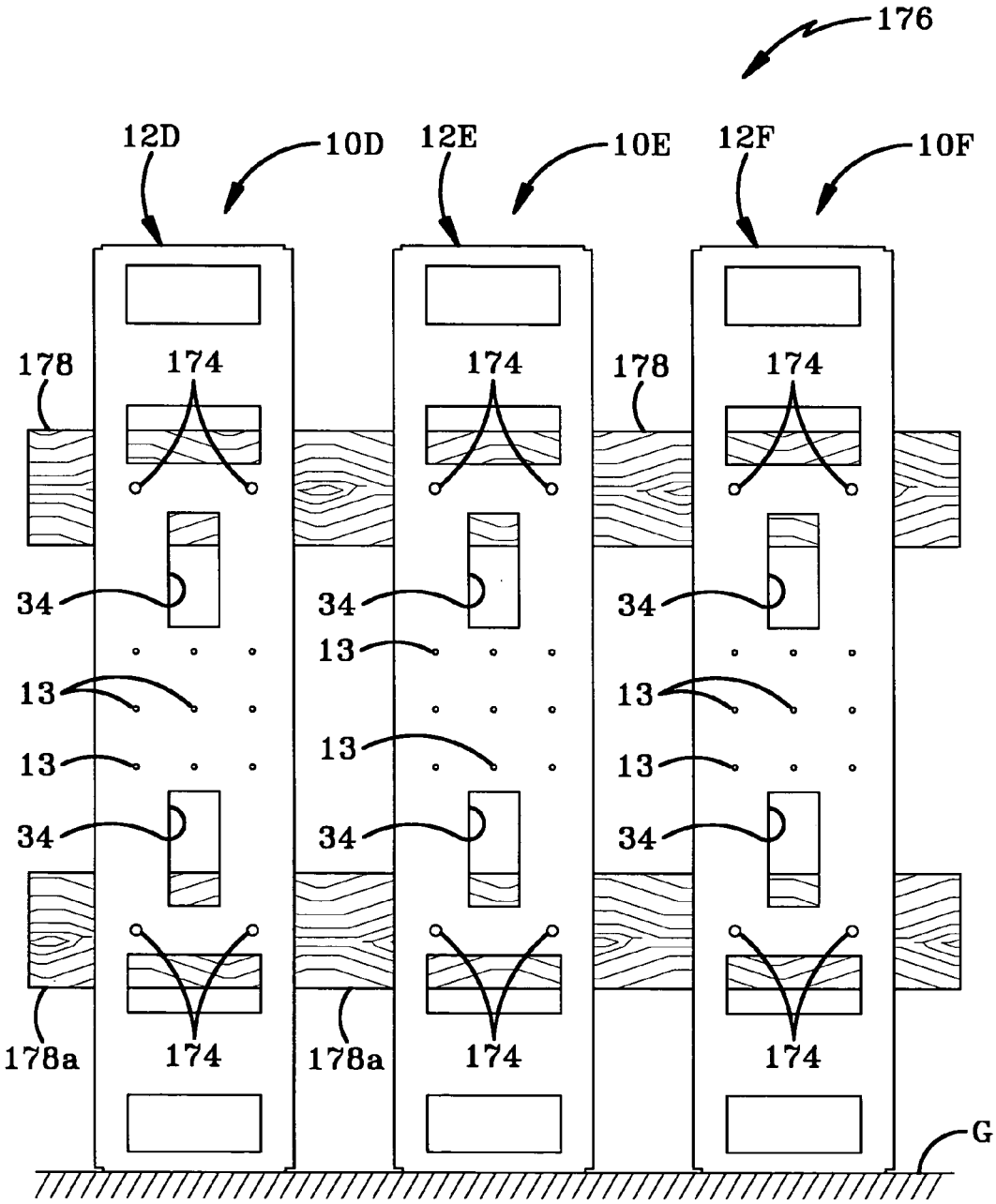
FIG. 17 is a side view of three racks connected together with 2×4 s.

Referring to FIGS. 15–17 a second rack system 176 may be formed by inserting lumber such as a 2"×4", generally indicated at 178 through a pair of coaxially aligned holes 34*a*, 34*b* in supports 12D, 12E and 12F of adjacent racks 10D, 10E and 10F. Pins or nails 174 are inserted through holes 13 and then driven into plank 178 to lock the same to each support 12D, 12E and 12F. Similarly, a second plank 178*a* can be used to secure the three supports 12D, 12E and 12F together toward their bases. It will be understood that lumber would also be secured to the supports 14 on the other side of racks 10D, 10E and 10F in the same manner, although this is not specifically illustrated.

Figure 18:
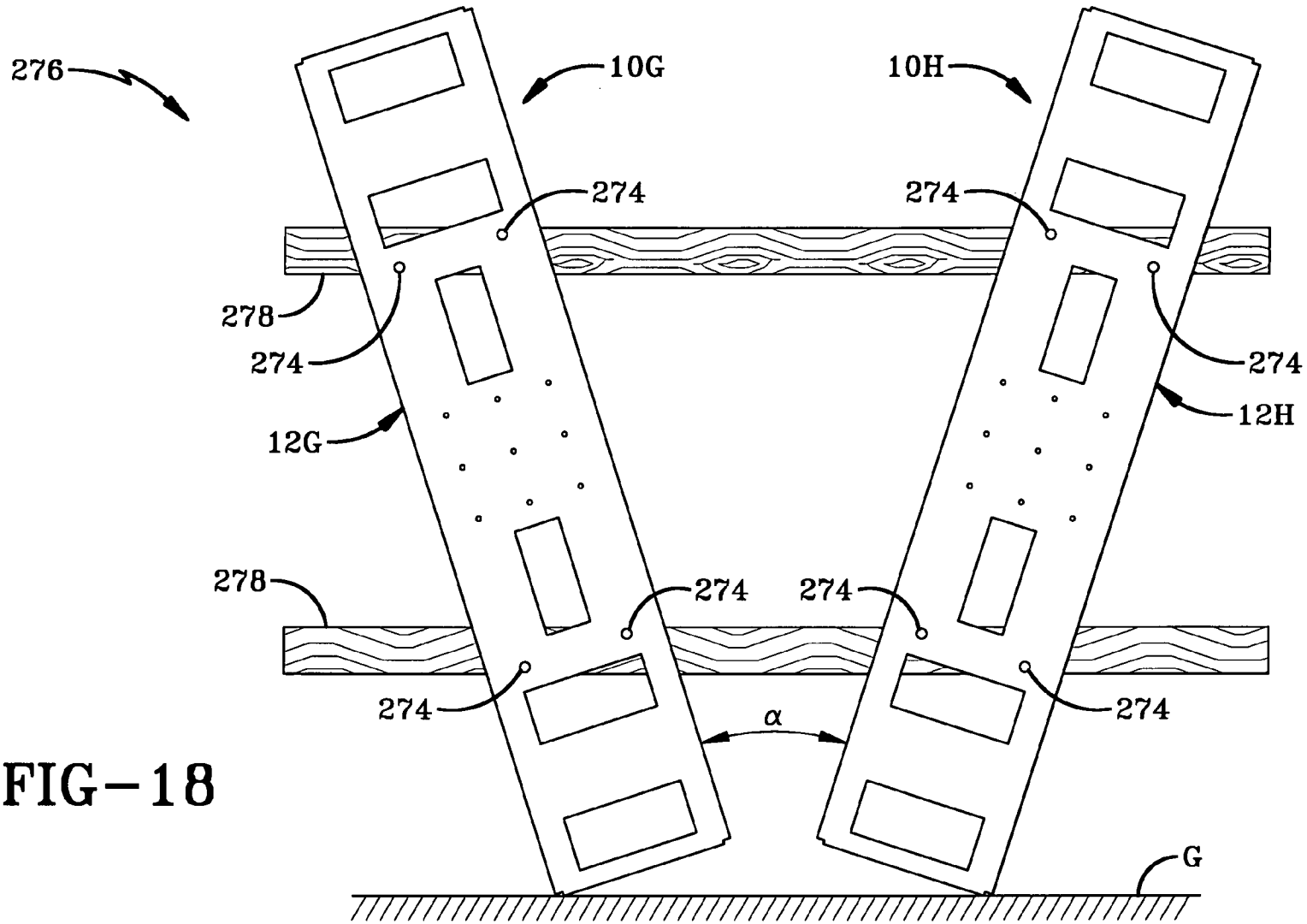
FIG. 18 is a side view of two racks connected together at an angle so that fireworks may be shot out of them at an angle.
Figure 19:
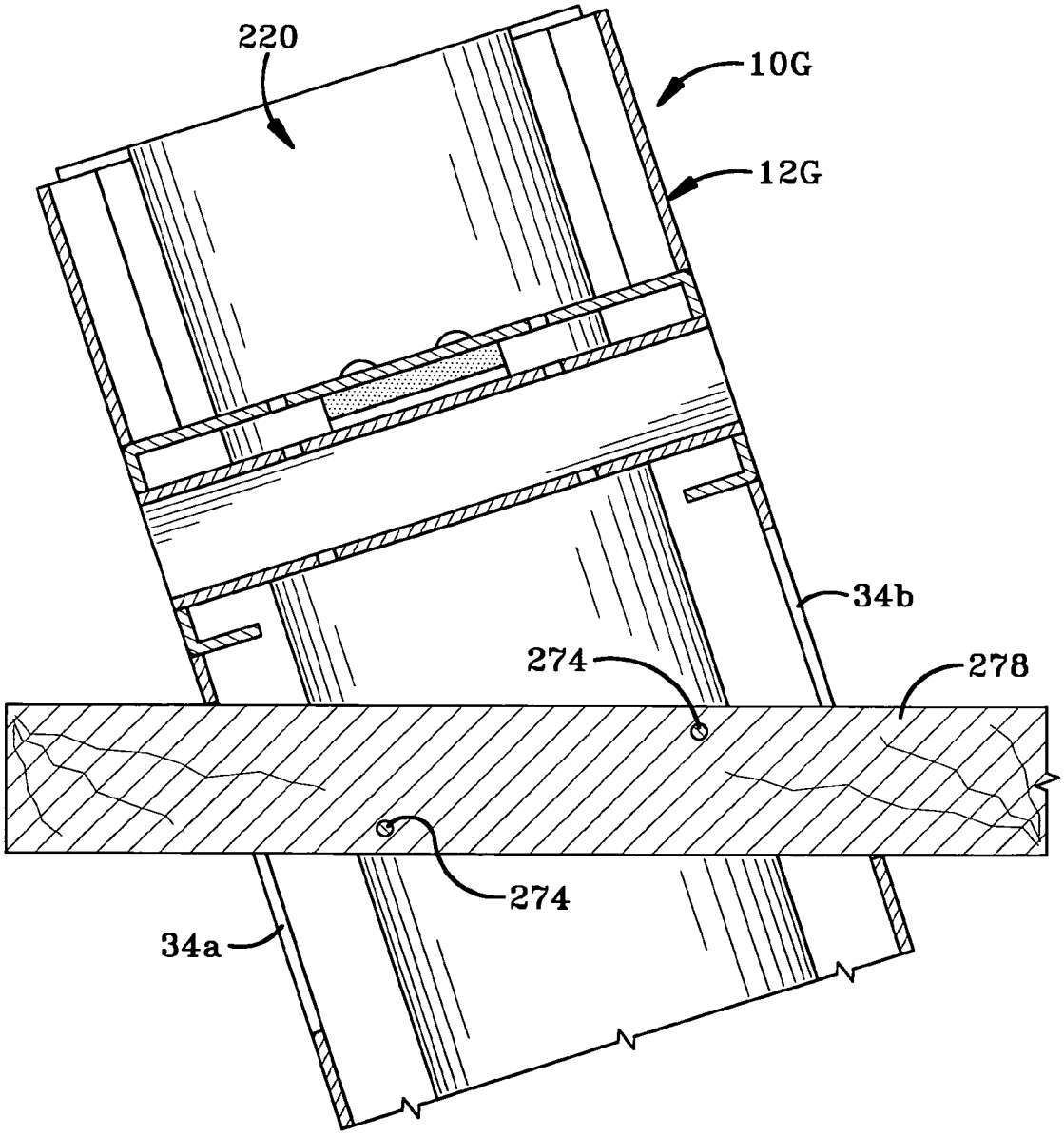
FIG. 19 is a partial cross-sectional side view of a rack tube showing how a connector is used to hold the tube at an angle.
Figure 20:
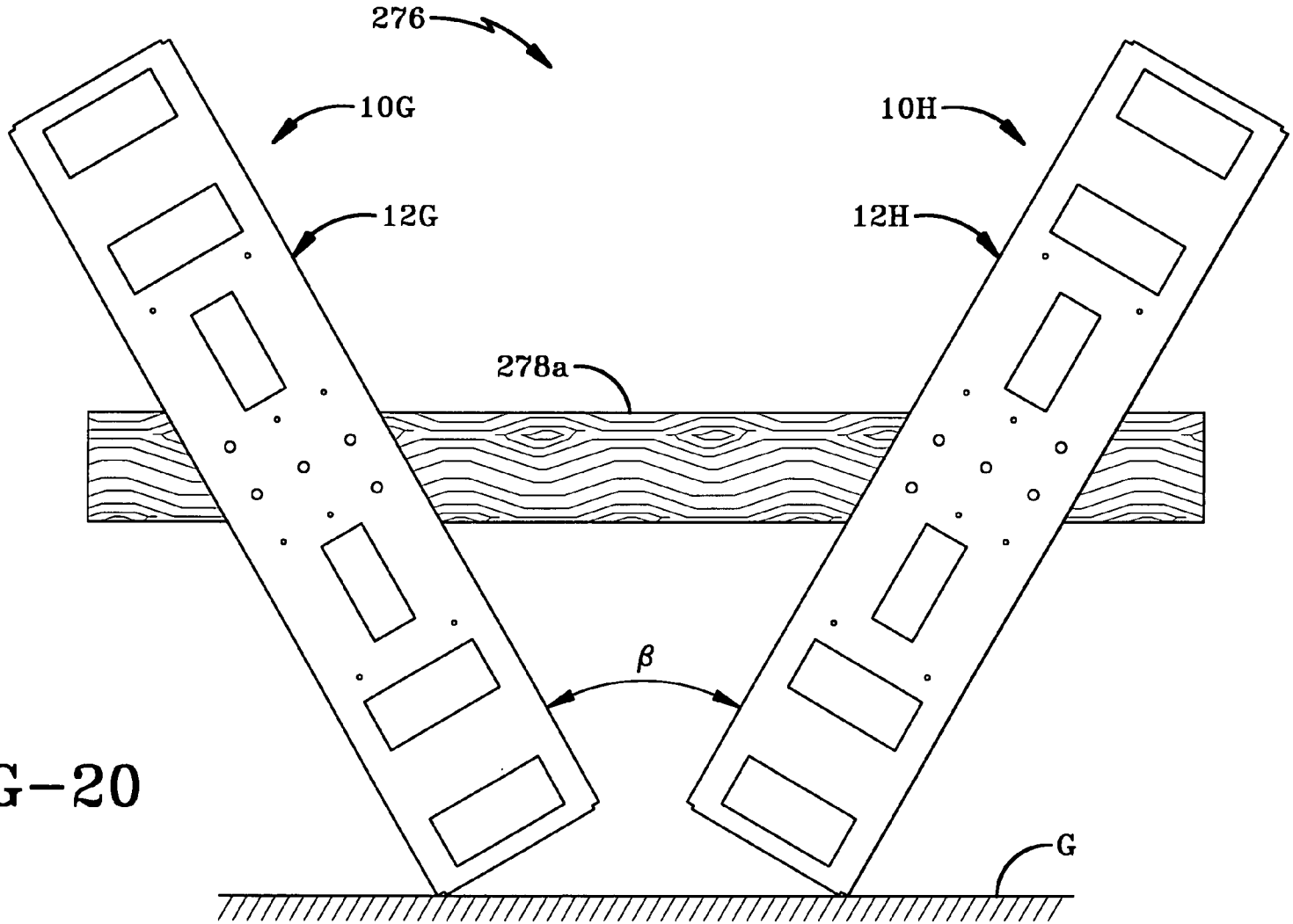
FIG. 20 is a side view of two racks connected together at an angle by a 2×4 plank.

Referring to FIGS. 18–19, a third rack system, generally indicated at 276, may be formed by inserting lumber 278 through the coaxially aligned holes 34*a*, 34*b* in adjacent racks 10G and 10H. Pins 278 are used to connect lumber 278 to supports 12G and 12H at an angle. In this instance, however, the lumber 278 used is of a lesser height than that of the holes 34*a*, 34*b*, e.g., the lumber 278 used may be 2"×2" instead of 2"×4". Alternatively, as is shown in FIG. 20, one single plank 278*a* can be used to hold racks 10G and 10H at an angle β relative to each other. This allows the racks 10G and 10H to be connected together at any angle α or β relative to each other, with a maximum angle being in the order of about 30°. Positioning the racks 10G and 10H at an angle relative to each other allows the fireworks held in the respective racks to be propelled outwardly from tubes 220 at an angle relative to each other. This may produce a more aesthetically pleasing fireworks display.

Figure 21:
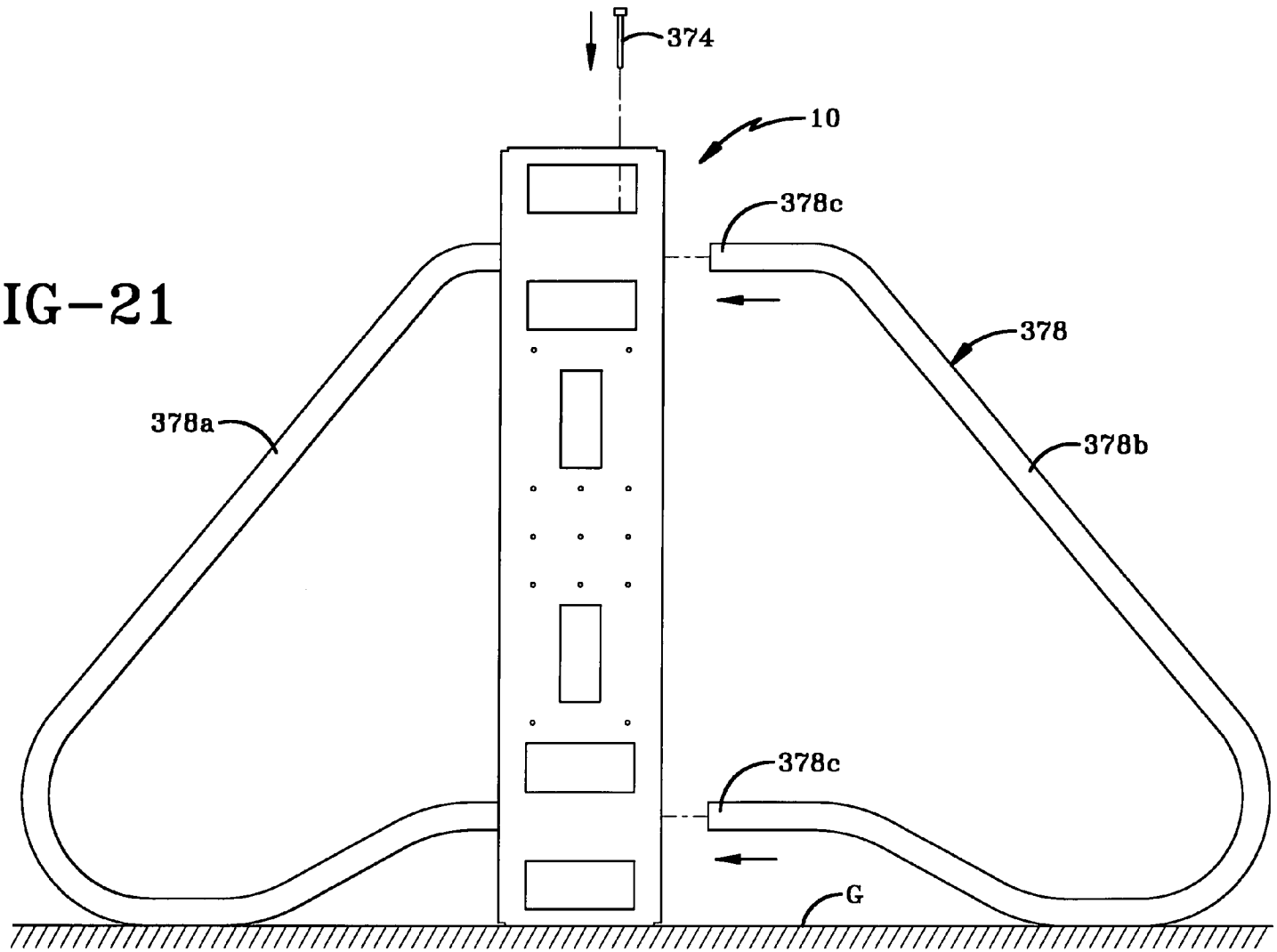
FIG. 21 is a side view of a rack showing a support to hold the rack in an upright position.

Referring to FIG. 21, a stand 378 may also be used to hold rack 10 in an upright position. The ends 378*c* of stand 378 may be inserted through the connector guides (not shown) of rack 10. In this instance, at least one pin 374 may be used to secure stand 378 to rack 310. Stand 378 has two legs 378*a*, 378*b* to hold rack 10 in an upright position.

Figure 22:
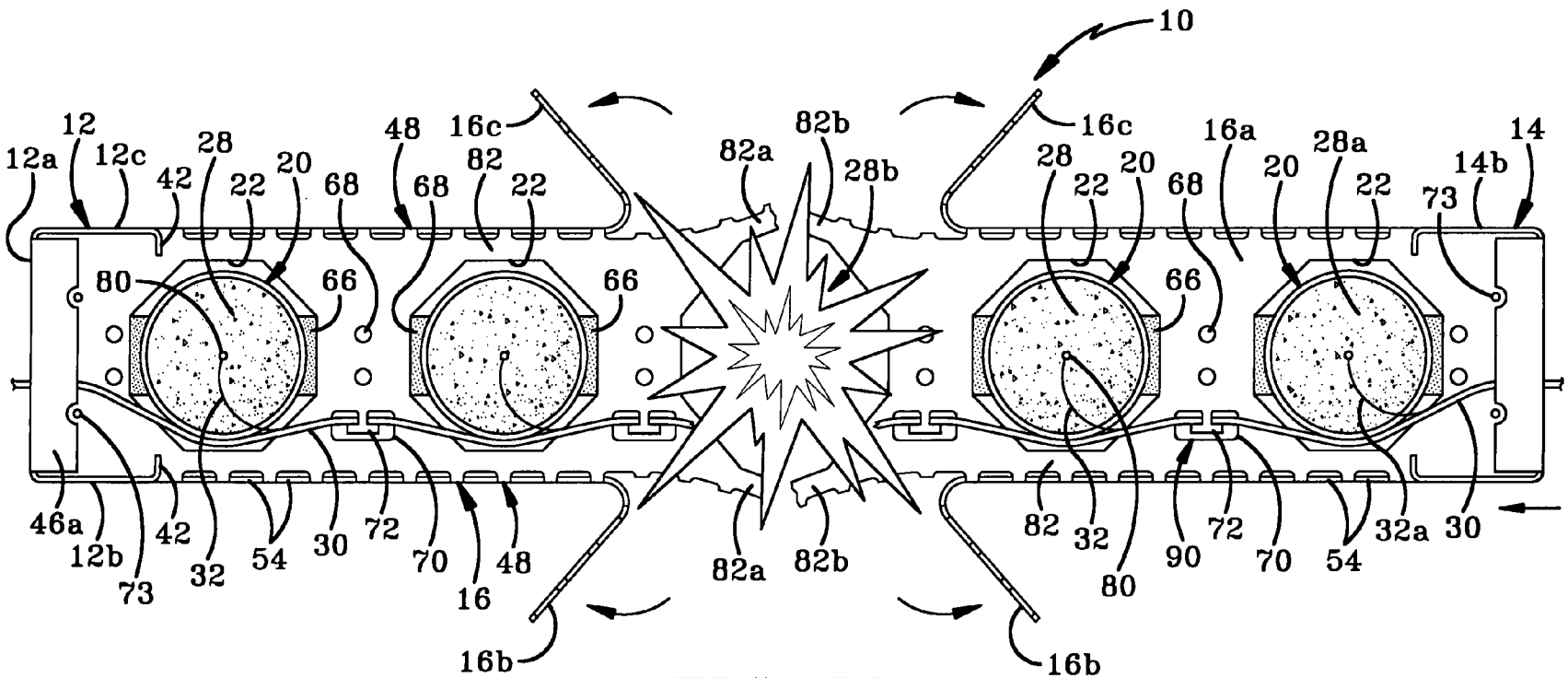
FIG. 22 is a top view of the rack showing an explosion occurring in one of the tubes.
Figure 23:
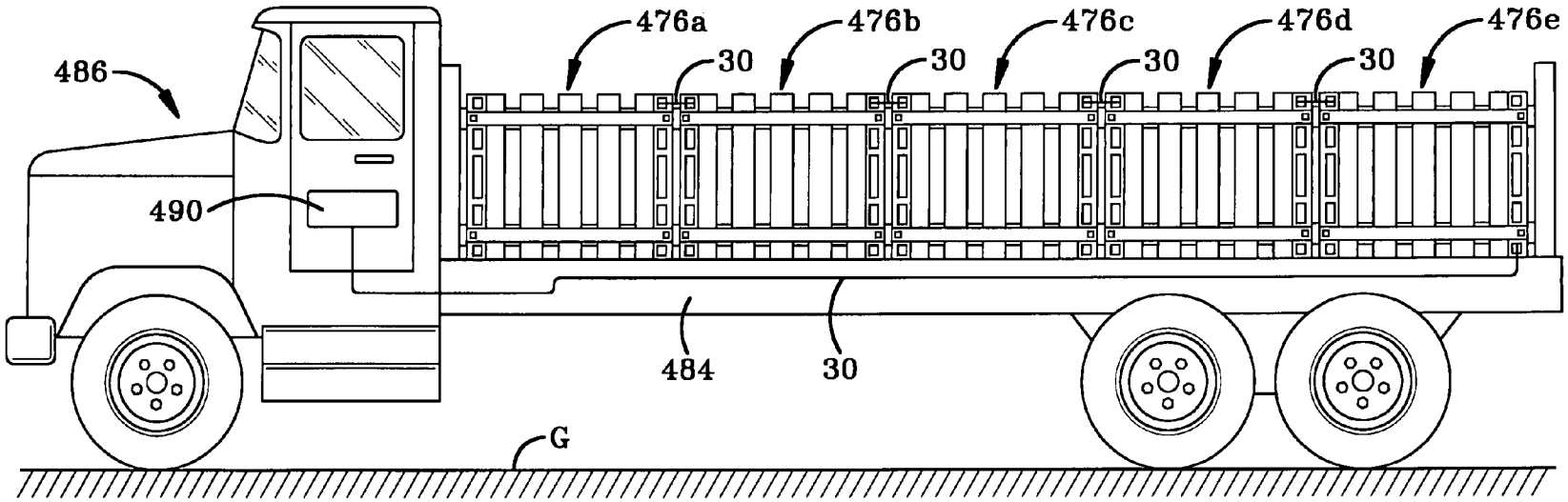
FIG. 23 is a side view of a truck with a plurality of racks mounted thereon.

Referring to FIGS. 1, 2, 5, 22 and 23, in use, rack 10 is positioned so that the lower end 12*d*, 14*d* of supports 12 and 14 and the lower ends 20*b* of the tubes 20 rest on the ground G or on the bed of a truck or barge. Pyrotechnic devices or fireworks 28 are inserted into tubes 20. An ignitor wire 32 connects a fuse 80 on each firework device 28 to the ignitor cord 30. Fuse 80 may be the brown wick paper that is disposed on the outside of firework 28. Ignitor cord 30 therefore has a plurality of ignitor wires 32 joining it at spaced intervals along its length. The ignitor cord extends from a suitable ignition source, such as control panel 490 (FIG. 23). A charge travels down cord 30 and outwardly along the ignitor wires 32, thereby sequentially setting the fuses 80 alight. As the explosive materials within the fireworks 28 are ignited, the fireworks are launched from their respective tubes 20. The launch of a firework device 28*a* causes its respective ignitor wire 32*a* to separate from the cord 30 because cord 30 is secured under tab 72 on brace 16. The recoil from the launch of firework 28*a* is absorbed by the ground G. Additionally, the recoil is dampened by bushing 66. These features assist in preventing rack 10 from tipping over during ignition of the fireworks 28 contained in rack 10.

Referring specifically to FIG. 22, there is shown an instance where one of the fireworks 28*b* held in rack 10 explodes upon ignition. Side walls 16*b* and 16*c* of brace 16 are able to tear away from upper wall 16*a* along corner edges 48 and 50. This is possible because the plurality of apertures 54 and 56 provide lines of weakness along corner edges 48 and 50. Small sections of material exist between apertures 54 and 56 along corner edges 48 and 50. These small sections of material can be better seen in FIG. 11, being indicated generally at 48*a*, 48*b*, 48*c* and 50*a*, 50*b* and 50*c*. If an explosion occurs, the force causes the small sections of material to break away sequentially, e.g., sections 48*a* and 50*a*, then 48*b* and 50*b* and then 48*c* and 50*c*. The piece of side wall 16*b* that extends between sections 48*a* and 50*a*, then 48*b* and 50*b* and finally 48*c* and 50*c*, tear away from upper wall 16*a* in sequence. The series of apertures 54 interspersed with sections of material 48*a*, 48*b*, 48*c* and series of apertures 56 interspersed with section 50*a*, 50*b*, 50*c* thereby define a tearaway zone or tear zipper along which the impact of an explosion can be at least partially absorbed. The pieces of upper wall 16*a* disposed between apertures 22 and corner edge 48, generally indicated at 82, are thin and narrow. As a result, if firework 28*b* explodes, pieces 82*a* and 82*b* separate from each other instead of being blown off upper wall 16*a*. Additionally, apertures 54, 56 and slots 58 provide passages for air escaping from the exploding pyrotechnic device 28*b*. All these features tend to reduce the outward force from the explosion and reduce the amount of shrapnel produced. All these features also help rack 10 absorb the shock of such an explosion and the tendency of the rack to tip over is greatly reduced. Rack 10 are herein contemplated is sufficiently strong enough to withstand a catastrophic event using shell recommendations of NFPA 1123 for rack firing.

FIG. 23 shows a series of racks systems 476*a*, 476*b*, 476*c*, 476*d* and 476*e* connected to each other and standing on the bed 484 of a truck trailer 486. Adjacent rack systems, such as 476*a* and 476*b*, are firingly joined together by ignitor cord 30. Rack systems 476*a* through 476*e* may be transported in this manner on the bed 484 of truck 486 or the bed 484 may be used as the launchpad for fireworks held within rack systems.

It will be understood by those skilled in the art that variously designed rack systems may be put together. The rack systems can include any number of racks that are joined together adjacently or end to end. More than two connector rods or lumber can be used to secure adjacent racks together. Additionally, the racks within the system may be mounted so that the tubes lie substantially at ninety degrees to the ground, or they may be mounted at another angle relative to the ground or each other or any combination of the these. Furthermore, racks having one, two, three or more rows of firework-holding tubes may be connected together. It will also be understood that the ignition cord for the racks in the system may be threaded from one rack to another.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A rack for holding pyrotechnic devices for ignition, the rack comprising: a frame having a pair of spaced apart end supports;

at least one brace connected between the end supports, the brace defining at least one aperture therein;

at least one hollow, cylindrical tube, the tube being received within the aperture in the brace, the tube being adapted to receive a pyrotechnic device therein;

wherein at least one of the end supports and the brace define at least one first hole therein, the first hole being adapted to allow air escaping from an exploding pyrotechnic device to pass through the rack.

2. The rack as defined in claim 1, wherein the brace is connected to the end supports so that it lies substantially at ninety degrees to the end supports.

3. The rack as defined in claim 2, wherein the tube lies substantially at ninety degrees to the brace.

4. The rack as defined in claim 3, wherein the end supports each have a lower end and the tube has a bottom end and the lower ends of the supports are coplanar with the bottom end of the tube.

5. The rack as defined in claim 4, wherein the tube is a hollow cylinder.

6. The rack as defined in claim 5, further comprising a second brace, the second brace being connected between the end supports so that it lies parallel to the brace, the second brace defining an aperture therein, the apertures in the brace and second brace being coaxially aligned with each other and the tube being received through the pair of coaxially aligned apertures.

7. The rack as defined in claim 6, wherein the brace and second brace define a plurality of spaced apart coaxially aligned pairs of apertures, and the frame includes a plurality of tubes, each tube being received within one of coaxially aligned pairs of apertures, each tube being adapted to receive a pyrotechnic device therein.

8. The rack as defined in claim 1, wherein a bushing is mounted on the brace so that it extends into the aperture.

9. The rack as defined in claim 1, wherein the brace and end supports are manufactured from aluminum.

10. The rack as defined in claim 1, wherein the tube is manufactured from one of high density polyethylene and fiberglass.

11. The rack as defined in claim 1, wherein the tube is adapted to rest directly on the surface supporting the rack.

12. The rack as defined in claim 1, wherein the end supports are each substantially U-shaped having a rear wall and two opposing side walls extending outwardly from the rear wall and at least one of the rear wall and side walls defines the first hole therein.

13. The rack as defined in claim 12, wherein each of the rear wall and side walls define at least one first hole therein.

14. The rack as defined in claim 1, wherein the brace is substantially U-shaped, having an upper wall and opposing side walls extending outwardly from the upper wall, the upper wall and side walls each meeting at a corner edge.

15. The rack as defined in claim 14, wherein the corner edges of the brace include a series of spaced apart first apertures, the series of first apertures defining a tear zipper for the side walls to separate from the upper wall in the event of an explosion in a pyrotechnic device held within the tube.

16. The rack as defined in claim 15, wherein the side walls of the brace each further include an inwardly extending flange, the flange of the side walls meeting at a second corner edge.

17. The rack as defined in claim 16, wherein the second corner edges of the brace include a series of spaced apart second apertures, the series of second apertures defining a second tear zipper for the side walls to separate from the flange in the event of an explosion in a pyrotechnic device.

18. The rack as defined in claim 14, wherein the side walls of the brace include a plurality of spaced apart slots, the slots being adapted to allow the passage of air from an exploding pyrotechnic device to pass therethrough.

19. The rack as defined in claim 1, wherein the frame further includes an ignitor cord retaining system.

20. The rack as defined in claim 19, wherein the ignitor cord retainer system is disposed on the brace.

21. The rack as defined in claim 20, wherein the ignitor cord retainer system comprises a plurality of spaced apart slots formed in the brace, each slot having a tab which extends at least partially into it, and the system is adapted to retain an ignitor cord threaded under the tabs in the slots.

22. The rack as defined in claim 21, wherein the brace has an upper wall and opposing side walls extending outwardly therefrom and the slots are formed in the upper wall of the brace.

23. The rack as defined in claim 22, wherein the tabs are T-shaped.

24. The rack as defined in claim 1, further comprising a second frame having:

a pair of spaced apart end supports;

at least one brace connected between the end supports, the brace defining at least one aperture therein;

at least one hollow, cylindrical tube, the tube being received within the aperture in the brace, the tube being adapted to receive a pyrotechnic device therein; wherein the frame and second frame are connectable to each other.

25. The rack as defined in claim 24, wherein the frame and second frame each have a length and a longitudinal axis and the end supports of the frame and second frame each define at least one first hole therethrough, the first holes being disposed at right angles to the longitudinal axis of the frame and second frame and a connector rod links the first hole of the frame and second frame together.

26. The rack as defined in claim 25, wherein the frame and first frame are positioned parallel to each other so that the first hole of the frame is coaxially aligned with the first hole of the second frame and the connector rod is passed through the aligned first holes of the frame and second frame.

27. The rack as defined in claim 26, wherein the end supports of the frame and second frame each include a rear wall and opposing side walls extending outwardly from the rear wall, and wherein the side walls of each end support each define a first hole therein, the first holes of the side walls of each end support of the side walls coaxially aligning with other.

28. The rack as defined in claim 27, wherein each of the end supports include a connector guide that extends between the coaxially aligned first holes of that end support and the connector rod is insertable between the connector guides of the adjacent end supports of the frame and second frame.

29. The rack as defined in claim 25, wherein the frame and second frame are longitudinally aligned with each other.

30. The rack as defined in claim 25, wherein the frame and second frame are connected together so that they are inclined at an angle relative to each other.

31. The rack as defined in claim 30, wherein the angle is up to about 30°.

32. The rack as defined in claim 25, wherein the frame and second frame are connected together by connector rods that are secured in place by connector pins.

33. The rack as defined in claim 32, wherein the connector rods are 2"×4" lumber.

34. The rack as defined by claim 32, wherein the connector rods are 2"×2" lumber.

35. The rack as defined in claim 32, wherein the connector rod has a perimeter that is smaller than the internal perimeter of the first holes in the end supports.

36. The rack as defined in claim 24, comprising a plurality of frames and second frames that are connected together to form a bank of pyrotechnic device holders.

* * * * *